US009829846B2

(12) United States Patent
Shimodaira et al.

(10) Patent No.: US 9,829,846 B2
(45) Date of Patent: Nov. 28, 2017

(54) SHEET TRANSPORT APPARATUS AND IMAGE FORMING APPARATUS

(71) Applicant: FUJI XEROX CO., LTD., Tokyo (JP)

(72) Inventors: Akira Shimodaira, Kanagawa (JP); Yukihiro Ichiki, Kanagawa (JP); Keita Hashimoto, Kanagawa (JP); Motoyuki Yagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/995,862

(22) Filed: Jan. 14, 2016

(65) Prior Publication Data

US 2017/0052496 A1 Feb. 23, 2017

(30) Foreign Application Priority Data

Aug. 18, 2015 (JP) ..... 2015-160927

(51) Int. Cl.
*G03G 15/00* (2006.01)
*B65H 5/36* (2006.01)
*B65H 29/52* (2006.01)

(52) U.S. Cl.
CPC ..... *G03G 15/6529* (2013.01); *B65H 5/36* (2013.01); *B65H 29/52* (2013.01); *B65H 2404/513* (2013.01); *B65H 2404/5211* (2013.01); *B65H 2404/5213* (2013.01); *G03G 15/657* (2013.01); *G03G 2215/00675* (2013.01); *G03G 2215/00679* (2013.01)

(58) Field of Classification Search
CPC ..... G03G 15/6529
USPC ..... 399/400
See application file for complete search history.

(56) References Cited

U.S. PATENT DOCUMENTS 6,957,035 B1 * 10/2005 Giannetti ..... G03G 15/657 271/194
8,045,914 B2 * 10/2011 Kato ..... G03G 15/6573 399/400
2004/0131399 A1 * 7/2004 Sahara ..... G03G 15/657 399/322
2007/0147920 A1 * 6/2007 Shimizu ..... B65H 5/38 399/400
2007/0248391 A1 * 10/2007 Yokokawa ..... G03G 15/657 399/400

(Continued)

FOREIGN PATENT DOCUMENTS

JP H04-277763 A 10/1992
JP H08-227231 A 9/1996

*Primary Examiner* — Anthony Nguyen
(74) *Attorney, Agent, or Firm* — Oliff PLC

(57) ABSTRACT

A sheet transport apparatus includes a first transport device, a second transport device, a first guide member, and a second guide member. The first transport device transports a sheet. The second transport device is disposed downstream of the first transport device in a transport direction and transports the sheet. The first guide member is disposed between the first and second transport device such that the second transport device is closer to the first guide member than the first transport device and guides the sheet to the second transport device. The second guide member is disposed between the first and second transport device such that the first transport device is closer to the second guide member than the second transport device and guides the sheet to the first guide member while curving the sheet.

15 Claims, 13 Drawing Sheets

(56) References Cited

U.S. PATENT DOCUMENTS

| | | | | |
|---|---|---|---|---|
| 2009/0026691 | A1* | 1/2009 | Ishikawa | B65H 5/062<br>271/10.12 |
| 2009/0279927 | A1* | 11/2009 | Fujita | G03G 15/657<br>399/316 |
| 2011/0081182 | A1* | 4/2011 | Takiguchi | G03G 15/657<br>399/400 |
| 2012/0251195 | A1* | 10/2012 | Ueyama | G03G 15/2017<br>399/307 |

* cited by examiner

SHEET TRANSPORT APPARATUS AND IMAGE FORMING APPARATUS

CROSS-REFERENCE TO RELATED APPLICATIONS

This application is based on and claims priority under 35 USC 119 from Japanese Patent Application No. 2015-160927 filed Aug. 18, 2015.

BACKGROUND (i) Technical Field

The present invention relates to a sheet transport apparatus and an image forming apparatus.

(ii) Related Art

In related-art image forming apparatuses, a recording medium is transported from a transfer unit, which transfers a toner image from a photosensitive drum or an intermediate transfer body to the recording medium, to a fixing device or the like.

SUMMARY

According to an aspect of the present invention, a sheet transport apparatus includes a first transport device, a second transport device, a first guide member, and a second guide member. The first transport device transports in a transport direction a sheet having one end portion and another end portion in a direction intersecting the transport direction and having a length of a preset value or more in the direction intersecting the transport direction. The second transport device is disposed downstream of the first transport device in the transport direction and transports the sheet. The first guide member has a flat plate shape, has a surface, is disposed between the first transport device and the second transport device such that the second transport device is closer to the first guide member than the first transport device, and guides the sheet to the second transport device. The second guide member is disposed between the first transport device and the second transport device such that the first transport device is closer to the second guide member than the second transport device and guides the sheet to the first guide member while curving the sheet such that the one end portion of the sheet and the other end portion of the sheet are separated from the surface of the first guide member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
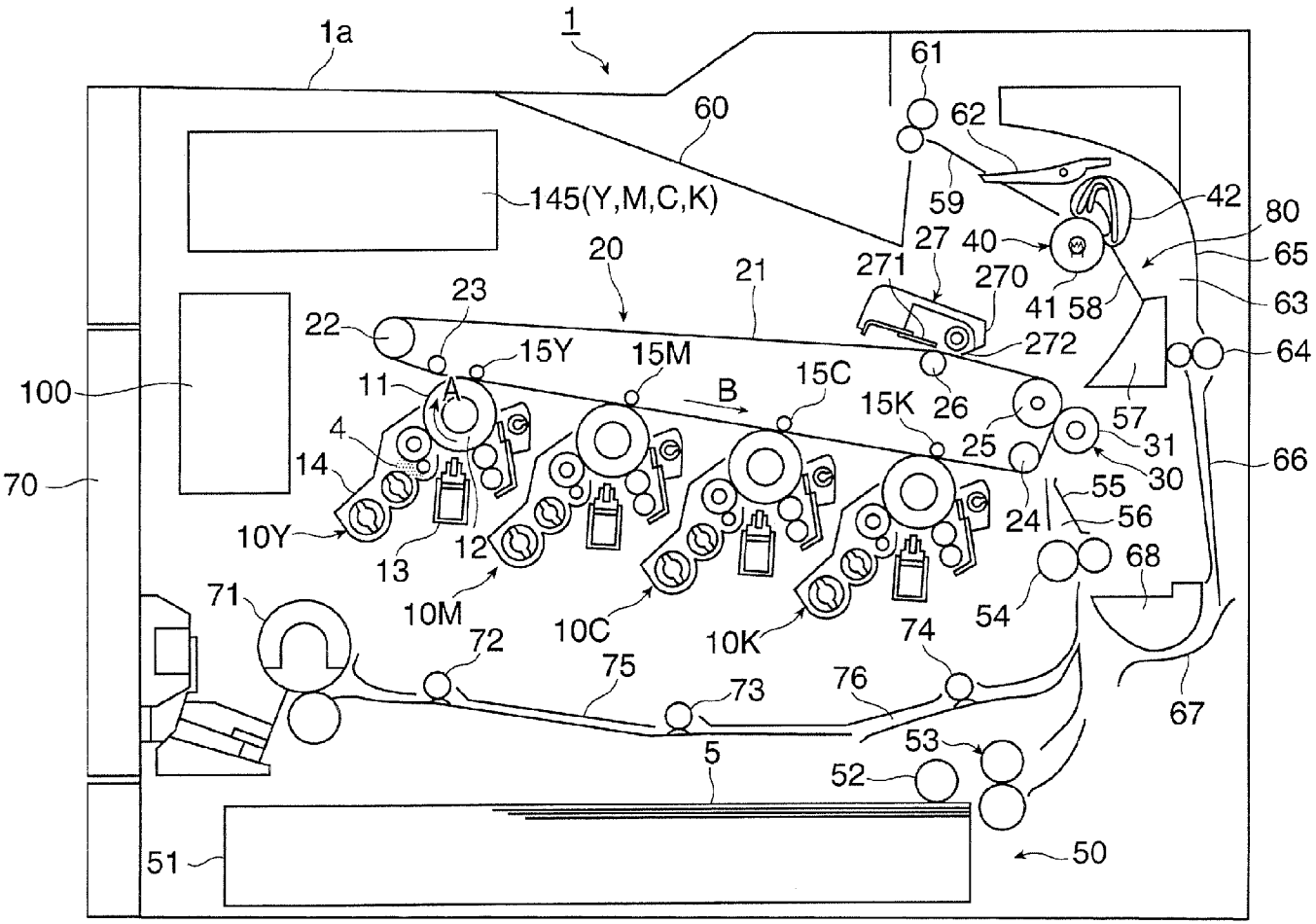
FIG. 1 is an overall view of a structure of an image forming apparatus to which a sheet transport apparatus according to a first exemplary embodiment of the present invention is applied.
Figure 2:
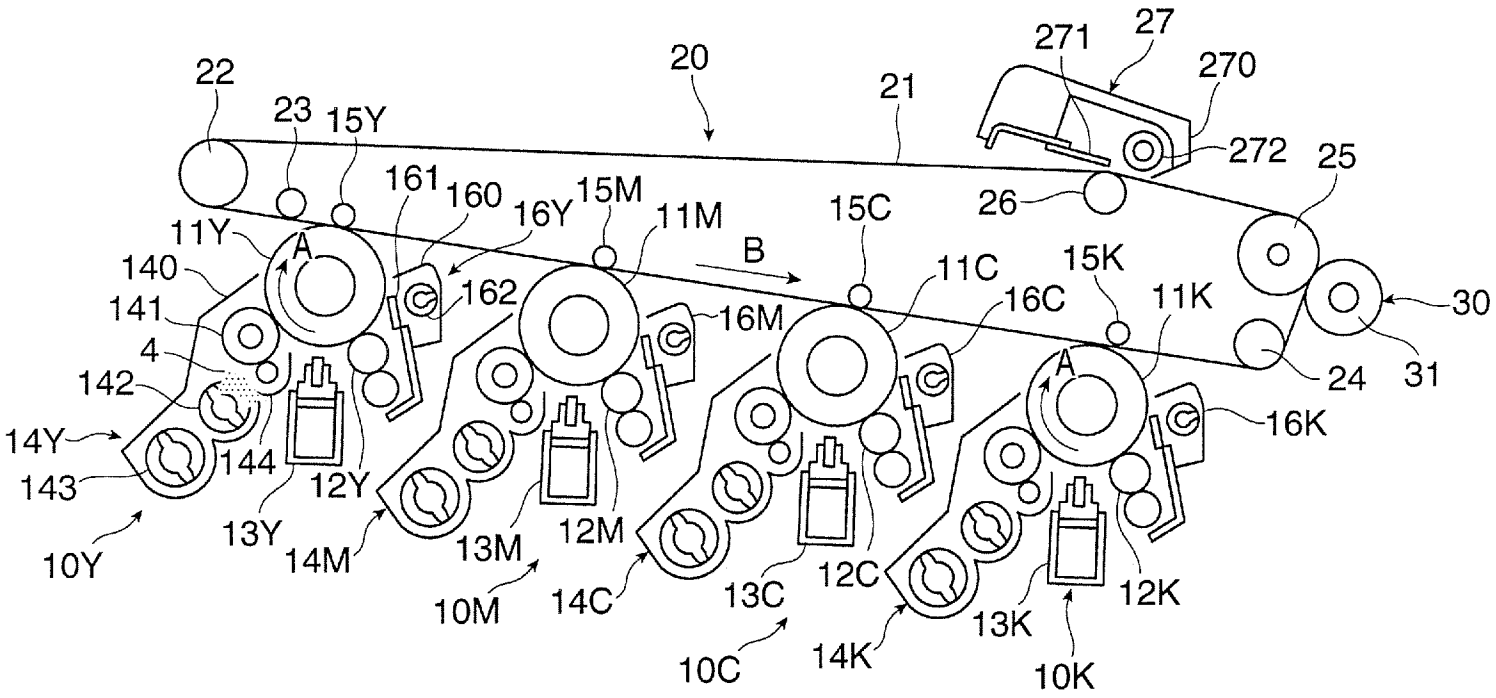
FIG. 2 is a view of a structure of an image forming section of the image forming apparatus to which the sheet transport apparatus according to the first exemplary embodiment of the present invention is applied.

FIG. 1 is an overall schematic view of an image forming apparatus to which a sheet transport apparatus according to a first exemplary embodiment of the present invention is applied. FIG. 2 is an enlarged view of parts (image forming devices and so forth) of this image forming apparatus.

Overall Structure of the Image Forming Apparatus

An image forming apparatus 1 according to a first exemplary embodiment is structured as, for example, a color printer. The image forming apparatus 1 includes plural image forming devices 10, an intermediate transfer device 20, a sheet feed device 50, a fixing device 40, and so forth. The image forming devices 10 forms toner images developed by toner included in developer 4. The intermediate transfer device 20 holds the toner images formed by the image forming devices 10 and transports the toner images to a second transfer position where the toner images are transferred onto recording sheets 5 at last through second transfer. The recording sheets 5 each serve as an example of a recording medium. The sheet feed device 50 contains and transports each of the required recording sheets 5 to be supplied to the second transfer position of the intermediate transfer device 20. The fixing device 40 fixes the toner images having been transferred onto the recording sheet 5 through the second transfer performed by the intermediate transfer device 20. Reference numeral 1*a* of, for example, FIG. 1 denotes a body of the image forming apparatus 1. The body 1*a* includes a support structural member, an exterior covering, and so forth.

The image forming devices 10 include four image forming devices 10Y, 10M, 10C, and 10K that each dedicatedly form a toner image of corresponding one of four colors, that is, yellow (Y), magenta (M), cyan (C), and black (K). These four image forming devices 10 (Y, M, C, and K) are inclined and arranged along a line in an inner space of the body 1*a*.

Each of the image forming devices 10 (Y, M, C, and K) includes a corresponding one of rotating photosensitive drums 11 as illustrated in FIGS. 1 and 2. The photosensitive drums 11 each serve as an example of an image holding body. The following devices are disposed around each of the photosensitive drums 11. These devices each serve as components of an example of a toner image forming device. For example, these devices include: a charger 12 that charges to a required potential a circumferential surface (image holding surface) of the photosensitive drum 11 where image formation is possible; a light exposure device 13 that radiates light in accordance with image information (signal) to the charged circumferential surface of the photosensitive drum 11 so as to form an electrostatic latent image having a potential difference for a corresponding one of the colors; a corresponding one of developing devices 14 (Y, M, C, and K) that serves as a developing unit and that develops the electrostatic latent image with the toner of the developer 4 of a corresponding one of the colors (Y, M, C, and K) so as to form a toner image; a corresponding one of first transfer devices 15 (Y, M, C, and K) that serves as an example of a first transfer unit and that transfers the toner image to the intermediate transfer device 20; and a corresponding one of drum cleaners 16 (Y, M, C, and K) that cleans the photosensitive drum 11 by removing adhering matter such as the toner that remains on and adheres to the image holding surface of the photosensitive drum 11 after first transfer has been performed.

Each of the photosensitive drums 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in a direction indicated by an arrow A by motive power transmitted from a rotational drive device (not illustrated).

The charger 12 includes a contact-type charging roller disposed so as to be in contact with the photosensitive drum 11. A charging voltage is supplied to the charger 12. In the case where the developing device 14 performs reversal development, a voltage or a current the polarity of which is the same as that of the toner supplied from this developing device 14 is supplied as the charging voltage. The charger 12 may be a contactless-type charging device such as a scorotron disposed on the surface of the photosensitive drum 11 in a state in which the charger 12 is not in contact with the photosensitive drum 11.

The light exposure device 13 forms the electrostatic latent image by radiating the light formed in accordance with the image information input to the image forming apparatus 1 to the circumferential surface of the charged photosensitive drum 11. The image information (signal) having been input to the image forming apparatus 1 by an arbitrary device is transmitted to the light exposure device 13 at a time when the latent image is formed.

The light exposure device 13 includes a light-emitting-diode (LED) print head. The LED print head includes plural LEDs as light emitting elements arranged in the axial direction of the photosensitive drum 11 so as to radiate the light in accordance with the image information to the photosensitive drum 11, thereby forming the electrostatic latent image. Alternatively, the light exposure device 13 may use a laser light formed in accordance with the image information to perform deflection scanning in the axial direction of the photosensitive drum 11.

As illustrated in FIG. 2, each of the developing devices 14 (Y, M, C, and K) includes, for example, the following components disposed in a housing 140 having an opening and a container chamber for the developer 4: that is, a developing roller 141, two agitation and transport members 142 and 143 such as two screw augers, and a layer thickness regulating member 144. The developing roller 141 holds the developer 4 and transports the developer 4 to a developing region that faces the photosensitive drum 11. The agitation and transport members 142 and 143 transport the developer 4 so as to cause the developer 4 to pass through the developing roller 141 while agitating the developer 4. The layer thickness regulating member 144 regulates the amount (layer thickness) of the developer 4 held by the developing roller 141. A developing voltage is supplied between the developing roller 141 and the photosensitive drum 11 of the developing device 14 from a power unit (not illustrated). The developing roller 141 and the agitation and transport members 142 and 143 are rotated in required directions by motive power transmitted thereto from a rotational drive device (not illustrated). Furthermore, two-component developer that includes non-magnetic toner and magnetic carrier is used as the developer 4 for each of four colors (Y, M, C, and K). Alternatively, single component developer that only includes toner may be used as the developer 4 for each of four colors (Y, M, C, and K).

Each of the first transfer devices 15 (Y, M, C, and K) is a contact-type transfer device that includes a first transfer roller that is in contact with a circumference of the photosensitive drum 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes components such as a body 160, a cleaning plate 161, and a feed member 162. The body 160 has a container shape and is partially opened. The cleaning plate 161 is disposed so as to be in contact at a required pressure with the circumferential surface of the photosensitive drum 11 having undergone the first transfer, thereby cleaning the circumferential surface of the photosensitive drum 11 by removing adhering matter such as residual toner. A screw auger or the like is used as the feed member 162 that collects the adhering matter such as the toner removed by the cleaning plate 161 and transports the removed adhering matter so that the adhering matter is fed to a collection system (not illustrated). A plate-shaped member formed of rubber or the like (for example, a cleaning blade) is used as the cleaning plate 161.

As illustrated in FIG. 1, the intermediate transfer device 20 is disposed above the image forming devices 10 (Y, M, C, and K). The intermediate transfer device 20 includes, for example, the intermediate transfer belt 21, plural belt support rollers 22 to 26, a second transfer device 30, and a belt cleaner 27. The intermediate transfer belt 21 is rotated in a direction indicated by an arrow B while passing through first transfer positions between the photosensitive drums 11 and the first transfer devices 15 (first transfer rollers). The belt support rollers 22 to 26 hold the intermediate transfer belt 21 in a state from inside and support the intermediate transfer belt 21 such that the intermediate transfer belt 21 is rotatable. The second transfer device 30 that serves as an example of a second transfer unit is disposed on an outer circumferential surface (image holding surface) side of the intermediate transfer belt 21 at a position where the intermediate transfer belt 21 is supported by the belt support roller 25. The second transfer device 30 transfers the toner images on the intermediate transfer belt 21 onto the recording sheet 5 through the second transfer. The belt cleaner 27 cleans an outer circumferential surface of the intermediate transfer belt 21 after the intermediate transfer belt 21 has passed through the second transfer device 30 by removing adhering matter such as the toner and paper dust remaining on and adhering to the outer circumferential surface of the intermediate transfer belt 21.

The intermediate transfer belt 21 is an endless belt formed of a material including, for example, synthetic resin such as polyimide resin or polyamide resin in which a resistance adjuster or the like such as carbon black is dispersed. The belt support roller 22 serves as a tension applying roller that applies tension to the intermediate transfer belt 21 and also serves as a meandering correction roller that corrects meandering of the intermediate transfer belt 21. The belt support rollers 23 and 24 serve as driven rollers that hold a running position of the intermediate transfer belt 21. The belt support roller 25 serves as a drive roller that is rotated by a drive device (not illustrated) and also serves as a backup roller included in the second transfer unit. The belt support roller 26 serves as a support roller that supports a rear surface of the intermediate transfer belt 21 at a position where the intermediate transfer belt 21 is cleaned by the belt cleaner 27.

As illustrated in FIG. 1, the second transfer device 30 is a contact-type transfer device that includes a second transfer roller 31 that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 25 of the intermediate transfer device 20. A second transfer voltage is supplied to the second transfer unit at the second transfer position. The second transfer device 30 includes the second transfer roller 31 and the belt support roller 25 serving as the backup roller. A direct-current voltage the polarity of which is the same as or opposite to the polarity to which the toner is charged is supplied to the second transfer roller 31 or the belt support roller 25 as the second transfer voltage.

As illustrated in FIG. 2, the belt cleaner 27 is structured similarly to the drum cleaner 16 and includes components such as a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer so as to clean the circumferential surface of the intermediate transfer belt 21 by removing adhering matter such as residual toner. A screw auger or the like is used as the feed member 272 that collects the adhering matter such as the toner removed by the cleaning plate 271 and transports the removed adhering matter so that the removed adhering matter is fed to the collection system (not illustrated). A plate-shaped member formed of rubber or the like (for example, a cleaning blade) is used as the cleaning plate 271.

The fixing device 40 includes components such as a heating rotating body 41 and a pressure rotating body 42. The heating rotating body 41 is in the form of a drum or a belt and is heated by a heating unit so that a surface temperature of the heating rotating body 41 is maintained at a required temperature. The pressure rotating body 42 is in the form of a drum or a belt (in the form of a belt in an example illustrated in, for example, FIG. 1), is in contact with the heating rotating body 41 in the substantially axial direction of the heating rotating body 41 at a specified pressure, and is rotated. A contact portion where the heating rotating body 41 and the pressure rotating body 42 are in contact with each other serves as a fixing process portion where required fixing processes (heating and applying pressure) are performed in the fixing device 40.

The sheet feed device 50 is disposed below the image forming devices 10 (Y, M, C, and K) for yellow (Y), magenta (M), cyan (C), and black (K). The sheet feed device 50 includes one or more sheet containers 51 and feed devices 52 and 53. The sheet container 51 or the sheet containers 51 contain the stacked recording sheets 5 of, for example, the size or sizes and the type or types a user wishes to use. The feed devices 52 and 53 feed one sheet after another from the recording sheets 5 in the sheet container 51 or each of the sheet containers 51. The sheet container 51 or the sheet containers 51 are attached so as to allow the sheet container 51 or the sheet containers 51 to be drawn toward, for example, a front surface side (side facing the user who operates the sheet container 51 or the sheet containers 51) of the body 1*a* which is the left side surface side in an example illustrated in FIG. 1.

Examples of the recording sheets 5 include plain paper used for electrophotographic copiers, printers, and so forth, overhead projector (OHP) transparencies, and thin paper such as tracing paper. In order to further improve smoothness of image surfaces after fixing, smoothness of the front side of the recording sheets 5 may be increased as much as possible. For example, coated paper made by coating the upper side of plain paper by resin or the like, so-called cardboard such as art paper for printing having a comparative large basis weight, and the like may also be used. According to classification of paper other than that based on the quality of paper, examples of the recording sheets 5 include paper such as envelopes and postcards having different forms from ordinary recording sheets. There are various sizes of envelopes. The sizes of envelops are roughly classified into the standard sizes and the non-standard sizes. The sizes of the rectangular type envelopes are, for example, as follows: rectangular type No. 1 (142×332 mm), rectangular type No. 2 (119×277 mm), rectangular type No. 3 (120×235 mm), rectangular type No. 4 (90×205 mm), rectangular type No. 5 (90×185 mm), and so forth. The sizes of postcards are as follows: post office printed postcards (100×148 mm), privately made postcards (short side: 90 to 107 mm×long side: 140 to 154 mm), large-sized postcards having a maximum size (120×235 mm) of the standard-sized sealed letter, and so forth.

A sheet feed transport path 56 is provided between the sheet feed device 50 and the second transfer device 30. The sheet feed transport path 56 includes one or more sheet transport roller pairs 54, a transport guide 55, and so forth. The sheet transport roller pair 54 or the sheet transport roller pairs 54 transport each of the recording sheets 5 fed from the sheet feed device 50 to the second transfer position. The sheet transport roller pair 54 serves as, for example, rollers that adjust timing at which the recording sheet 5 is transported (registration rollers). Furthermore, a first transport guide 58 that serves as an example of a first guide member and a second transport guide 57 that serves as an example of a second guide member are provided between the second transfer device 30 and the fixing device 40. The recording sheet 5 having undergone the second transfer and fed from the second transfer roller 31 of the second transfer device 30 is transported to the fixing device 40 through the first transport guide 58 and the second transport guide 57. Furthermore, a sheet output roller pair 61 is disposed near a sheet output opening formed in the image forming apparatus body 1*a*. The sheet output roller pair 61 is used for outputting the recording sheet 5 having undergone fixing and fed from the fixing device 40 to a sheet output unit 60 provided in an upper portion of the body 1*a* along a transport guide 59. The detailed structures of the first and second transport guides 58 and 57 will be described later.

A switching gate 62 is provided between the fixing device 40 and the sheet output roller pair 61. The switching gate 62 switches the sheet transport path. The rotational direction of the sheet output roller pair 61 is switchable between a forward direction (output direction) and a reverse direction. In order to form images on both sides of the recording sheet 5, the rotational direction of the sheet output roller pair 61 is switched from the forward direction (output direction) to the reverse direction after a trailing end of the recording sheet 5 on one side of which an image had been formed has been passed through the switching gate 62. The transport path of the recording sheet 5 to be transported in the reverse direction by the sheet output roller pair 61 is switched by the switching gate 62, so that this recording sheet 5 is transported to a duplex transport path 63 extending in the substantially vertical direction along the side surface of the body 1*a*. The duplex transport path 63 includes a sheet transport roller pair 64, transport guides 65 to 68, and so forth. The sheet transport roller pair 64 transports the recording sheet 5 in an inverted state to the sheet transport roller pair 54.

Reference numeral 70 of FIG. 1 denotes a manual feed tray openably provided on the front surface (left side surface of FIG. 1) of the body 1*a* of the image forming apparatus 1. A manual feed sheet transport path 76 is provided between the manual feed tray 70 and the sheet transport roller pair 54 or the sheet transport roller pairs 54. The manual feed sheet transport path 76 is provided with a feed device 71, plural sheet transport roller pairs 72 to 74, a transport guide 75, and so forth. The feed device 71 feeds the recording sheets 5 loaded in the manual feed tray 70 one sheet after another.

Furthermore, reference numerals 145 (Y, M, C, and K) of FIG. 1 denote plural toner cartridges that are arranged in a direction perpendicular to the page of FIG. 1 and contain the developer that includes at least the toner supplied to the respective developing devices 14 (Y, M, C, and K).

Furthermore, reference numeral 100 of FIG. 1 denotes a controller that entirely controls operations of the image forming apparatus 1. The controller 100 includes components and so forth (not illustrated) such as a central processing unit (CPU), a read only memory (ROM), a random access memory (RAM), buses through which these CPU, ROM, and so forth are connected, and a communication interface.

Operation of the Image Forming Apparatus

Basic image forming operation performed by the image forming apparatus 1 are described below.

Here, an operation in which a full-color image is formed by combining the toner images of four colors (Y, M, C, and K) performed by four image forming devices 10 (Y, M, C, and K) is described.

Upon reception of instruction information requesting the image forming operation (printing), the image forming apparatus 1 starts four image forming devices 10 (Y, M, C, and K), the intermediate transfer device 20, the second transfer device 30, the fixing device 40, and so forth.

Consequently, in the image forming devices 10 (Y, M, C, and K), the photosensitive drums 11 are initially rotated in the arrow A direction, and the chargers 12 charge the surfaces of the respective photosensitive drums 11 to the required polarity (negative polarity according to the first exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10 (Y, M, C, and K) each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color.

Next, when the toner images of the colors formed on the photosensitive drums 11 of the image forming devices 10 (Y, M, C, and K) are transported to the first transfer positions, the first transfer devices 15 transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10 where the first transfer has been performed. Thus, the image forming devices 10 are ready to perform the next image forming operation.

Next, the toner images having been transferred onto the intermediate transfer belt 21 through the first transfer are held and transported to the second transfer position by rotating the intermediate transfer belt 21 in the intermediate transfer device 20. Meanwhile, the sheet feed device 50 feeds the required recording sheet 5 to the sheet feed transport path 56 in accordance with the image forming operation. The recording sheet 5 is fed and supplied to the second transfer position by the sheet transport roller pair 54 or the sheet transport roller pairs 54 serving as the registration rollers at timing adjusted to timing of the transfer in the sheet feed transport path 56.

The second transfer roller 31 of the second transfer device 30 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as the toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and the second transfer roller 31 and then transported to the fixing device 40 through the first transport guide 58 and the second transport guide 57. The recording sheet 5 having undergone the second transfer is introduced into and passes through the contact portion between the heating rotating body 41 being rotated and the pressure rotating body 42 being rotated so as to be subjected to required fixing processes (heating and application of pressure) in the fixing device 40. Thus, the unfixed toner images are fixed onto the recording sheet 5. At last, in the case of the image forming operation where image formation is performed on only one of the sides of the recording sheet 5, the recording sheet 5 having undergone the fixing is output to the sheet output unit 60 provided in the upper portion of the body 1*a* by the sheet output roller pair 61.

Furthermore, in the case where images are formed on both sides of the recording sheet 5, the recording sheet 5 on one side of which an image has been formed is not output to the sheet output unit 60 by the sheet output roller pair 61. Instead, the rotational direction of the sheet output roller pair 61 is switched to the reverse direction while the trailing end of the recording sheet 5 is held by the sheet output roller pair 61. The recording sheet 5 transported in the reverse direction by the sheet output roller pair 61 passes through the upper side of the switching gate 62. Then, the recording sheet 5 is inverted while passing through the duplex transport path 63 including the sheet transport roller pair 64, the transport guides 65 to 68, and so forth and transported to the sheet transport roller pair 54 or the sheet transport roller pairs 54. The sheet transport roller pair 54 or the sheet transport roller pairs 54 feed and supply the recording sheet 5 to the second transfer position at timing adjusted to timing of the transfer, so that an image is formed on the back side of the recording sheet 5, and the recording sheet 5 is output to the sheet output unit 60 provided in the upper portion of the body 1*a* by the sheet output roller pair 61.

Through the above-described operation, the recording sheet 5 is output on which the full-color image made by combining the toner images of four colors has been formed. Of course, the image forming apparatus 1 may also form a monochrome image on the recording sheet 5 by using only the image forming device 10K for black (K).

Structure of Parts of the Image Forming Apparatus

Figure 3:
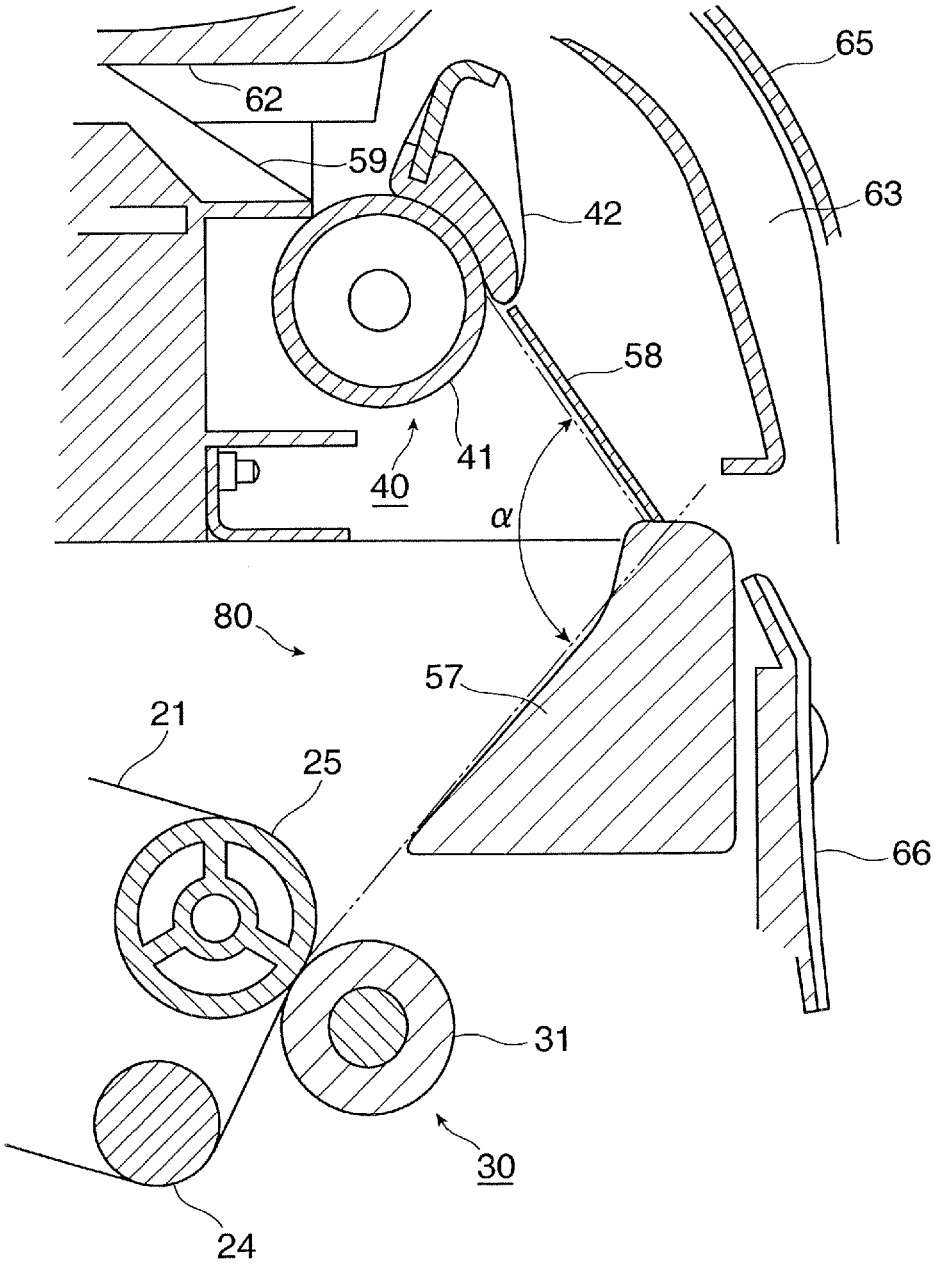
FIG. 3 is a view of a structure of part of the image forming apparatus to which the sheet transport apparatus according to the first exemplary embodiment of the present invention is applied.

As illustrated in FIGS. 1 and 3, the image forming apparatus 1 includes a sheet transport apparatus 80 that transports the recording sheet 5 from the second transfer device 30 serving as an example of a first transport device to the fixing device 40 serving as an example of a second transport device. The sheet transport apparatus 80 includes the first transport guide 58 having a plate shape and the second transport guide 57. The first transport guide 58 is disposed between the second transfer device 30 and the fixing device 40 such that the fixing device 40 is closer to the first transport guide 58 than the second transfer device 30. The first transport guide 58 serving as a first guide member guides the recording sheet 5 to the fixing device 40. The second transport guide 57 is disposed between the second transfer device 30 and the fixing device 40 such that the second transfer device 30 is closer to the second transport guide 57 than the fixing device 40. The second transport guide 57 serving as a second guide member guides the recording sheet 5 a length of which in a direction intersecting a transport direction (referred to as "width" hereafter) is a preset value or more to the first transport guide 58 while curving the recording sheet 5 such that both end portions of the recording sheet 5 in a direction intersecting the transport direction (may also be referred to as "width direction" hereafter) are separated from a surface of the first transport guide 58. It is noted that, according to the present exemplary embodiment, a so-called center registration method is adopted, in which the recording sheet 5 is transported with reference to a central portion in the width direction.

The length of the transport path of the recording sheet 5 from the second transfer device 30 to the fixing device 40 is set to be shorter than the length of a minimum-sized recording sheet 5 having a length in the transport direction which is the shortest for the image forming apparatus 1 to be able to form an image. That is, the recording sheet 5 is transported to the fixing device 40 through the first transport guide 58 and the second transport guide 57 by a transport force of the second transfer device 30.

The transport direction of the recording sheet 5 transported by the second transfer device 30 is the same as or substantially the same as a tangent direction at a pressure contact portion between the second transfer roller 31 and the backup roller 25. Furthermore, the transport direction of the recording sheet 5 on the entrance side of the fixing device 40 is the same as or substantially the same as a tangent direction at a pressure contact portion between the heating rotating body 41 and the pressure rotating body 42. According to the present exemplary embodiment, the transport direction of the recording sheet 5 transported by the second transfer device 30 and the transport direction of the recording sheet 5 transported by the fixing device 40 are not linear but form an obtuse angle $\alpha$ which is a required angle. A direction in which the second transport guide 57 guides the recording sheet 5 is set to be coincident with or substantially coincident with the transport direction of the recording sheet 5 transported by the second transfer device 30. Furthermore, a direction in which the first transport guide 58 guides the recording sheet 5 is set to be coincident with or substantially coincident with the transport direction of the recording sheet 5 transported by the fixing device 40.

The recording sheet 5 is transported in a direction along the second transport guide 57 and then brought into contact with the first transport guide 58. This contact with the first transport guide 58 changes the transport direction of the recording sheet 5 to a direction along the first transport guide 58 so as to transport the recording sheet 5 to the fixing device 40. The transport speed of the recording sheet 5 transported by the second transfer device 30 and that transported by the fixing device 40 are set to be the same or set such that the transportation speed of the recording sheet 5 transported by the fixing device 40 is slightly slower than that transported by the second transfer device 30. The recording sheet 5 is curved in the direction along the second transport guide 57 and the first transport guide 58 while being transported between the second transfer device 30 and the fixing device 40.

How the recording sheet 5 is curved while being transported between the second transfer device 30 and the fixing device 40 varies in accordance with arrangement of the second transport guide 57 and the first transport guide 58 and physical properties such as the width and the stiffness (basis weight) of the recording sheet 5. The recording sheet 5 transported by the second transfer device 30 is guided in the direction along the second transport guide 57 and brought into contact with the surface of the first transport guide 58 after the direction of a leading end of the recording sheet 5 is changed to the direction along the first transport guide 58.

The first transport guide 58 has a flat plate shape as illustrated in FIG. 3 and is formed of a material such as heat-resistant synthetic resin or metal. The first transport guide 58 is disposed on the pressure rotating body 42 side of the fixing device 40 and extends from an end portion (upper end portion of, for example, FIG. 3) of the second transport guide 57 on a downstream side in the transport direction of the recording sheet 5 to an entrance of the pressure contact portion of the fixing device 40.

The second transport guide 57 is integrally formed of synthetic resin or the like by injection molding. Alternatively, the second transport guide 57 may be partially separately formed. The second transport guide 57 extends from a position separated from the pressure contact portion between the second transfer roller 31 and the backup roller 25 of the second transfer device 30 by a required distance L on the downstream side in the transport direction of the recording sheet 5 to the first transport guide 58.

Figure 4:
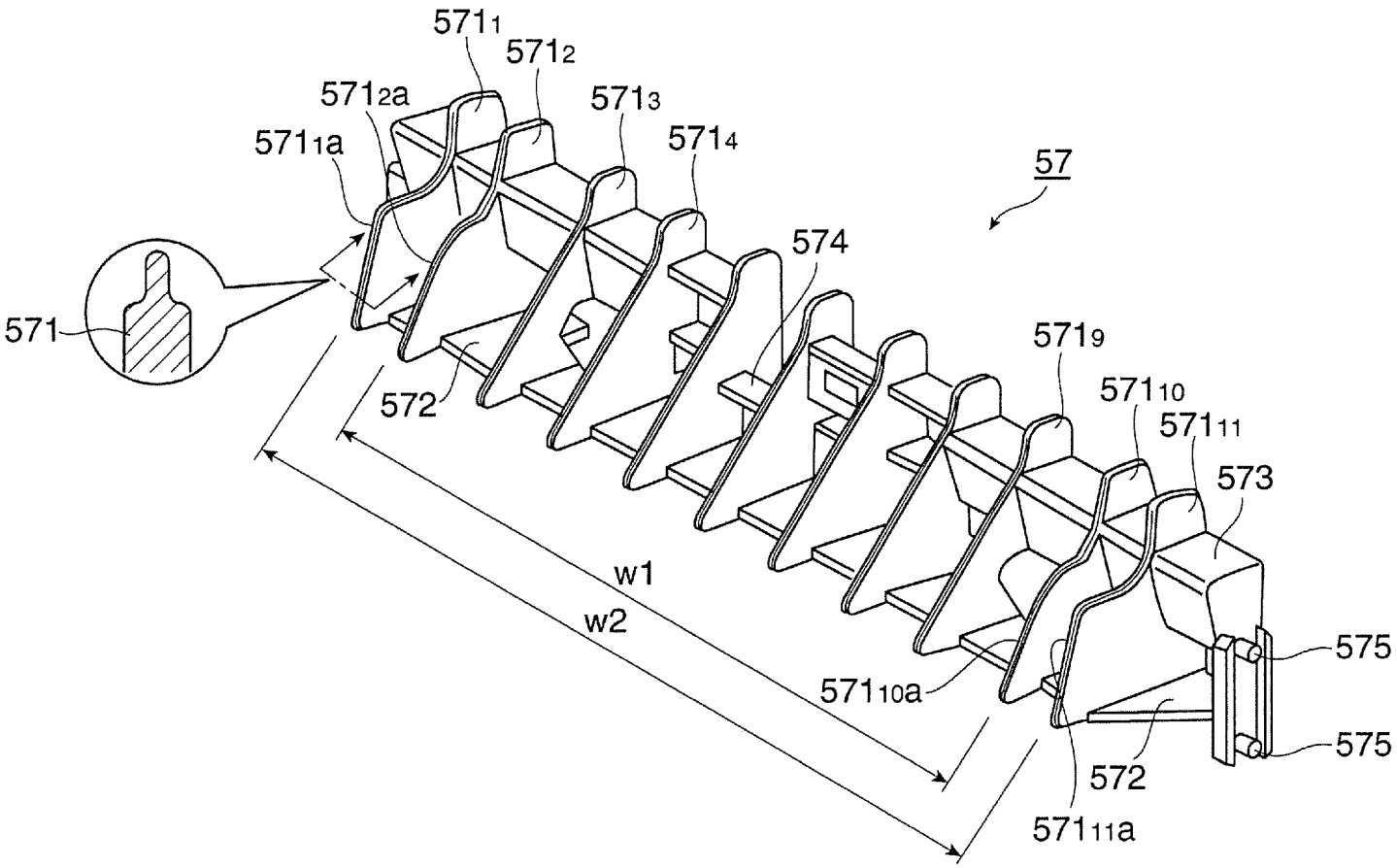
FIG. 4 is a perspective view of a structure of a second transport guide according to the first exemplary embodiment of the present invention.
Figure 5A:
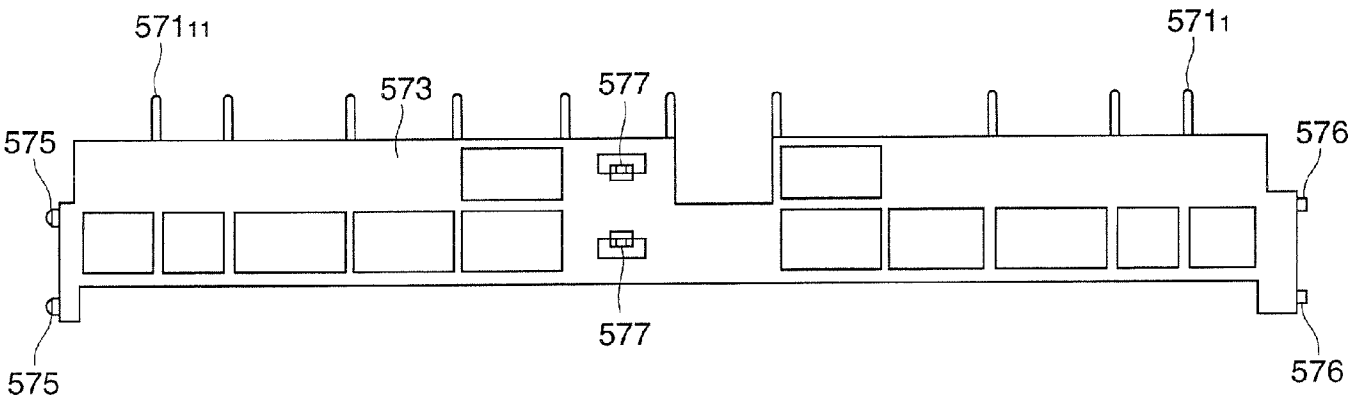
FIGS. 5A and 5B are respectively a rear view and a plan view of the structure of the second transport guide according to the first exemplary embodiment of the present invention.
Figure 5B:
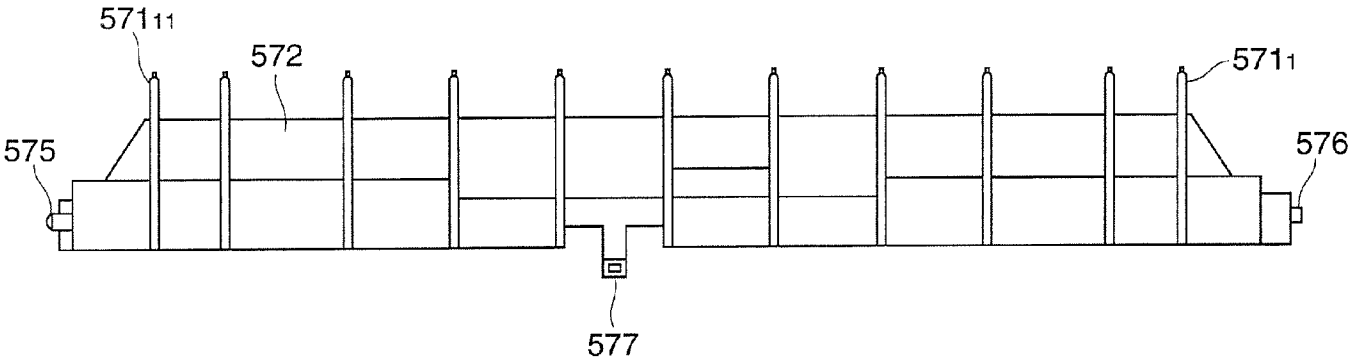

As illustrated in FIGS. 4 to 6, the second transport guide 57 includes plural (11 in an example illustrated in, for example, FIG. 4) guide plates $\mathbf{571}_1$ to $\mathbf{571}_{11}$. The guide plates $\mathbf{571}_1$ to $\mathbf{571}_{11}$ each have a flat plate shape having a substantially trapezoidal shape in side view and guide the recording sheet 5. The plural guide plates $\mathbf{571}_1$ to $\mathbf{571}_{11}$ are disposed perpendicular to the side of the recording sheet 5. Furthermore, a left side surface of each of the plural guide plates $\mathbf{571}_1$ to $\mathbf{571}_{11}$ as viewed in FIG. 4 are parts of a guide surface that guides the recording sheet 5. The plural guide plates $\mathbf{571}_1$ to $\mathbf{571}_{11}$ are integrally connected by plural connecting portions 572, 573, and 574 disposed in portions such as a bottom portion and an upper portion such that the plural guide plates $\mathbf{571}_1$ to $\mathbf{571}_{11}$ are spaced from one another at required intervals in the width direction of the recording sheet 5 so as to be parallel to one another. Furthermore, the second transport guide 57 is detachably attached to the body 1*a* or at a required position of a covering provided in the body 1*a* of the image forming apparatus 1 by attachment projections 575, attachment projections 576, and retainers 577 such that the covering is able to be opened and closed. The attachment projections 575 are provided at one end portion and the attachment projections 576 are provided at another end portion of the second transport guide 57, the one and the other end portions located at ends in the longitudinal direction of the second transport guide 57. The retainers 577 are provided on a rear surface side of the second transport guide 57 at a central portion in the longitudinal direction of the second transport guide 57.

As illustrated in FIG. 4, the plural guide plates $\mathbf{571}_1$ to $\mathbf{571}_{11}$ are roughly classified into first guide plates $\mathbf{571}_3$ to $\mathbf{571}_9$, second guide plates $\mathbf{571}_2$ and $\mathbf{571}_{10}$, and third guide plates $\mathbf{571}_1$ and $\mathbf{571}_{11}$. The first guide plates $\mathbf{571}_3$ to $\mathbf{571}_9$ are disposed within a range having a length of a first threshold w1 in the width direction of the recording sheet 5. The second guide plates $\mathbf{571}_2$ and $\mathbf{571}_{10}$ are disposed at positions that are at both ends of the range having the first threshold w1 length in the width direction of the recording sheet 5. The third guide plates $\mathbf{571}_1$ and $\mathbf{571}_{11}$ are disposed at positions (both ends) separated from each other by a length of a second threshold w2 located outside the range having the first threshold w1 length in the width direction of the recording sheet 5. As illustrated in FIG. 6B, the first guide plates $\mathbf{571}_3$ to $\mathbf{571}_9$ have a substantially triangular shape in which left side edges $\mathbf{571}_3a$ to $\mathbf{571}_9a$ are inclined at an angle θ1 relative to the horizontal direction. Furthermore, upper end portions $\mathbf{571}_3b$ to $\mathbf{571}_9b$ of the left side edges $\mathbf{571}_3a$ to $\mathbf{571}_9a$ extend from curved portions $\mathbf{571}_3c$ to $\mathbf{571}_9c$ upward in the substantially vertical direction to have a short linear shape. The upper end portions $\mathbf{571}_3b$ to $\mathbf{571}_9b$ and the curved portions $\mathbf{571}_3c$ to $\mathbf{571}_9c$ of the second transport guide 57 are included in a redirect structure that changes the transport direction of the recording sheet 5.

Figure 6A:
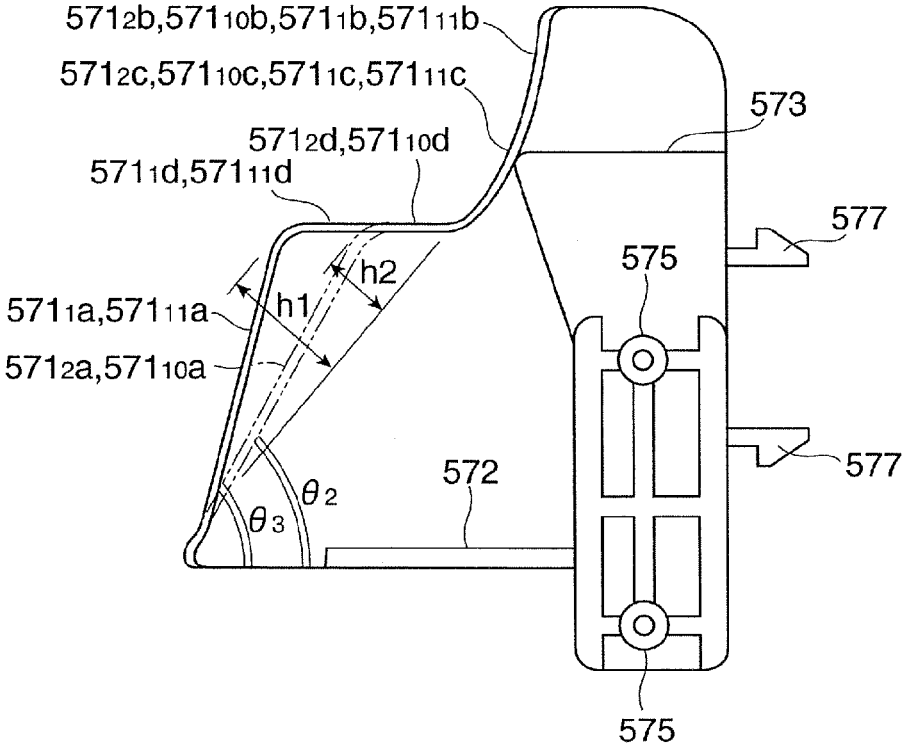
FIGS. 6A and 6B are respectively a side view and a sectional view of the structure of the second transport guide according to the first exemplary embodiment of the present invention.
Figure 6B:
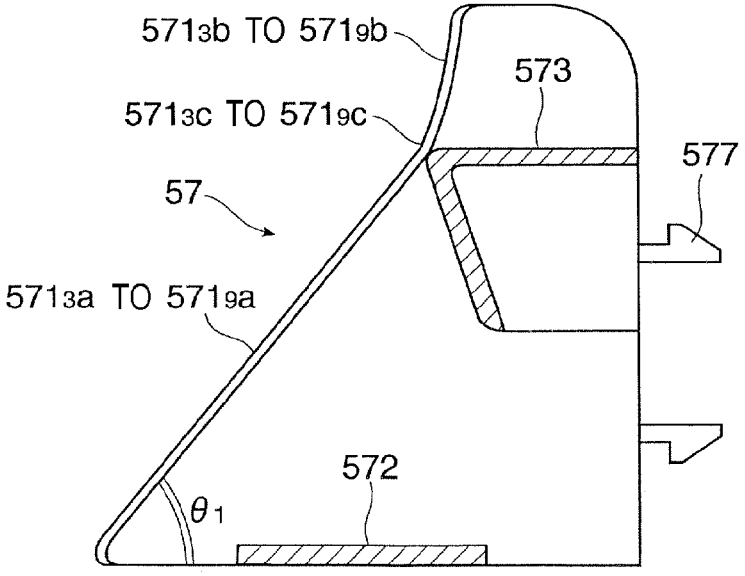

The second guide plates $\mathbf{571}_2$ and $\mathbf{571}_{10}$ are formed such that, as indicated by two-dot chain lines of FIG. 6A, left side edges $\mathbf{571}_2a$ and $\mathbf{571}_{10}a$ are inclined relative to the horizontal direction at an angle θ2 that is greater than the angle θ1 at which the first guide plates $\mathbf{571}_3$ to $\mathbf{571}_9$ are inclined relative to the horizontal direction. Furthermore, distal end portions $\mathbf{571}_2d$ and $\mathbf{571}_{10}d$ of the left side edges $\mathbf{571}_2a$ and $\mathbf{571}_{10}a$ horizontally extend and are connected to upper end parts of the left side edges $\mathbf{571}_2a$ and $\mathbf{571}_{10}a$. Furthermore, as is the case with the first guide plates $\mathbf{571}_3$ to $\mathbf{571}_9$, upper end portions $\mathbf{571}_2b$ and $\mathbf{571}_{10}b$ of the second guide plates $\mathbf{571}_2$ and $\mathbf{571}_{10}$ extend from curved portions $\mathbf{571}_2c$ and $\mathbf{571}_{10}c$ upward in the substantially vertical direction to have a short linear shape. The upper end portions $\mathbf{571}_2b$ and $\mathbf{571}_{10}b$ and the curved portions $\mathbf{571}_2c$ and $\mathbf{571}_{10}c$ of the second guide plates $\mathbf{571}_2$ and $\mathbf{571}_{10}$ are included in the redirect structure that changes the transport direction of the recording sheet 5.

As a result, as illustrated in FIG. 6A, the left side edges $\mathbf{571}_2a$ and $\mathbf{571}_{10}a$ of the second guide plates $\mathbf{571}_2$ and $\mathbf{571}_{10}$ project relative to a transport plane for the recording sheet 5 by a height h2.

The third guide plates $\mathbf{571}_1$ and $\mathbf{571}_{11}$ are, as illustrated in FIG. 6A, formed to have a substantially trapezoidal shape in which left side edges $\mathbf{571}_1a$ and $\mathbf{571}_{11}a$ are inclined relative to the horizontal direction at an angle θ3 that is greater than the angle θ2 at which the second guide plates $\mathbf{571}_2$ and $\mathbf{571}_{10}$ are inclined relative to the horizontal direction. Furthermore, distal end portions $\mathbf{571}_1d$ and $\mathbf{571}_{11}d$ of the left side edges $\mathbf{571}_1a$ and $\mathbf{571}_{11}a$ horizontally extend and are connected to upper end parts of the left side edges $\mathbf{571}_1a$ and $\mathbf{571}_{11}a$. Furthermore, as is the case with the first guide plates $\mathbf{571}_3$ to $\mathbf{571}_9$, upper end portions $\mathbf{571}_1b$ and $\mathbf{571}_{11}b$ of the third guide plates $\mathbf{571}_1$ and $\mathbf{571}_{11}$ extend from curved portions $\mathbf{571}_1c$ and $\mathbf{571}_{11}c$ upward in the substantially vertical direction to have a short linear shape. The upper end portions $\mathbf{571}_1b$ and $\mathbf{571}_{11}b$ and the curved portions $\mathbf{571}_1c$ and $\mathbf{571}_{11}c$ of the third guide plates $\mathbf{571}_1$ and $\mathbf{571}_{11}$ are included in the redirect structure that changes the transport direction of the recording sheet 5.

As a result, as illustrated in FIG. 6A, the left side edges $\mathbf{571}_1a$ and $\mathbf{571}_{11}a$ of the third guide plates $\mathbf{571}_1$ and $\mathbf{571}_{11}$ project relative to the transport plane for the recording sheet 5 by a height h1 higher than that of the second guide plates $\mathbf{571}_2$ and $\mathbf{571}_{10}$. According to the present exemplary embodiment, as illustrated in FIG. 4, the thickness of the left side edges of the guide plates 571 is reduced so as to reduce contact resistance between the guide plates 571 and the recording sheet 5.

Operation of the Sheet Transport Apparatus

According to the present exemplary embodiment, as illustrated in FIG. 3, the recording sheet 5 transported by the second transfer device 30 is further transported to the fixing device 40 through the second transport guide 57 and the first transport guide 58.

Figure 7:
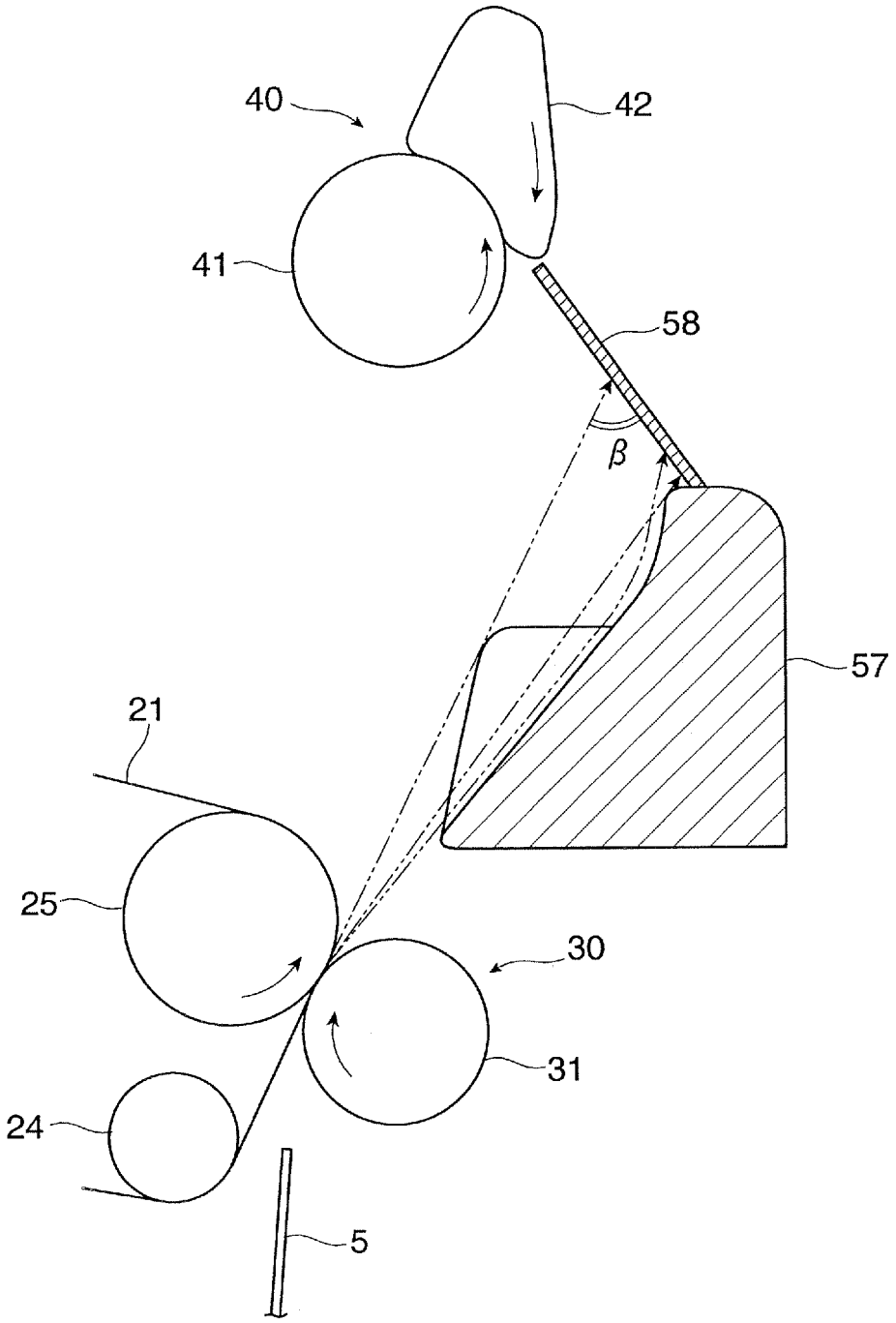
FIG. 7 is a view of a structure of the sheet transport apparatus according to the first exemplary embodiment of the present invention.

That is, the recording sheet 5 on which the toner images on the intermediate transfer belt 21 have been transferred through the second transfer by the second transfer device 30 is, as illustrated in FIGS. 3 and 7, transported to the fixing device 40 by the belt support roller 25 that perform transportation on the intermediate transfer belt 21 and the second transfer roller 31 in pressure contact with the belt support roller 25 with the intermediate transfer belt 21 interposed therebetween. The second transport guide 57 and the first transport guide 58 are disposed between the second transfer device 30 and the fixing device 40.

Figure 8:
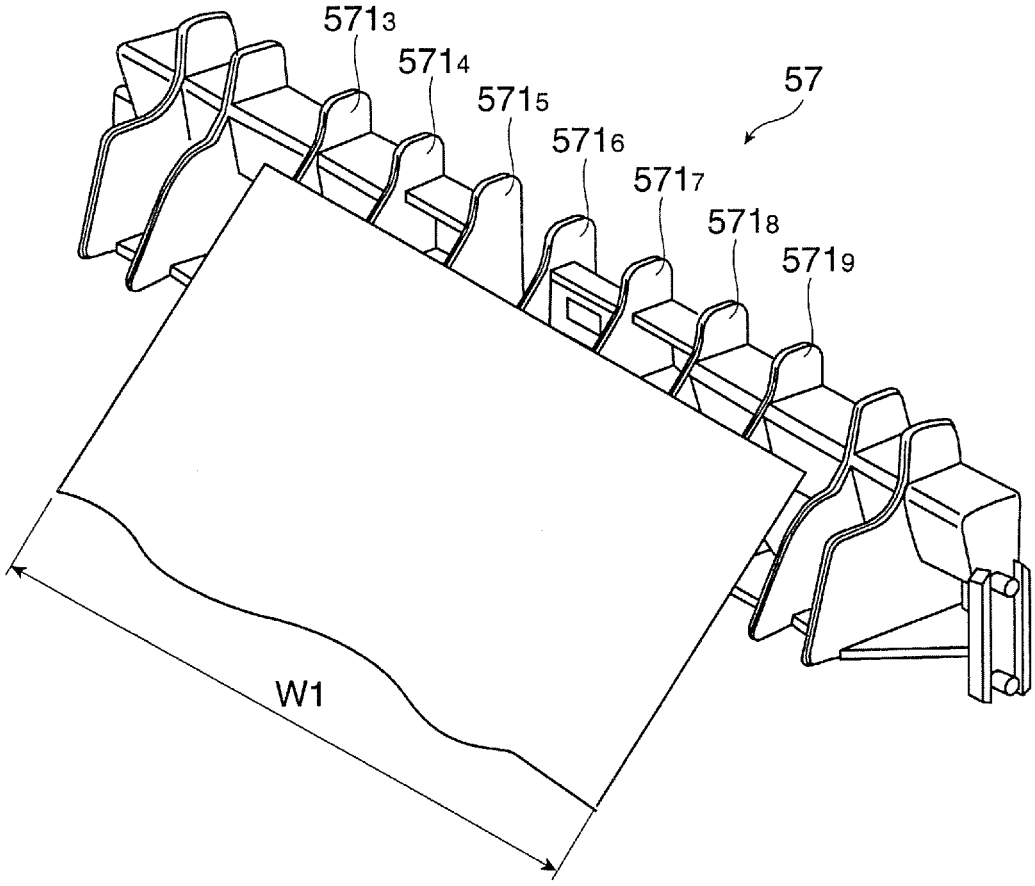
FIG. 8 illustrates an operation of the sheet transport apparatus according to the first exemplary embodiment of the present invention.

How the recording sheet 5 is transported through the second transport guide 57 varies in accordance with the width of the recording sheet 5. When a width W1 of the recording sheet 5 is less than the first threshold w1 (W1<w1), as illustrated in FIG. 8, the recording sheet 5 is transported while being guided by the first guide plates $\mathbf{571}_3$ to $\mathbf{571}_9$ of the second transport guide 57 over the entire width of the recording sheet 5. The inclination angle θ at proximal end portions of the left side edges $\mathbf{571}_3a$ to $\mathbf{571}_9a$ of the first guide plates $\mathbf{571}_3$ to $\mathbf{571}_9$ is set to be smaller than those of the second and third guide plates $\mathbf{571}_2$, $\mathbf{571}_{10}$, $\mathbf{571}_1$, and $\mathbf{571}_{11}$. The recording sheet 5 is guided to the first transport guide 58 while being held in a flat state (such that the height is uniform in the direction intersecting the transport direction) with the entire width of a non-image side (back side) being in contact with the proximal end portions and the upper end parts of the first guide plates $\mathbf{571}_3$ to $\mathbf{571}_9$.

As illustrated in FIG. 7, an edge of the leading end of the recording sheet 5 having been guided to the first transport guide 58 is uniformly brought into contact with the surface of the first transport guide 58 having a flat plate shape and guided to a nip of the fixing device 40 by the first transport guide 58 while being held in the flat state.

Figure 9:
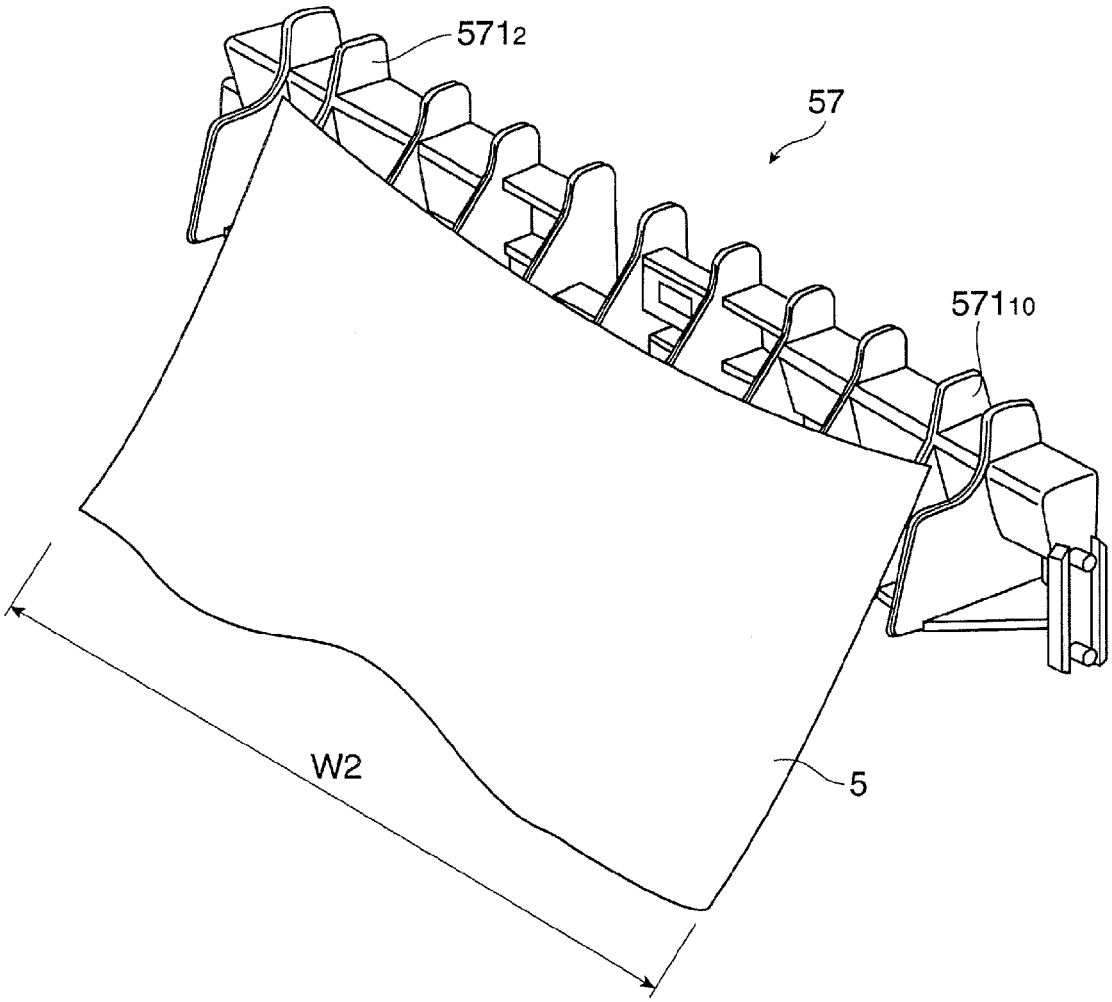
FIG. 9 illustrates the operation of the sheet transport apparatus according to the first exemplary embodiment of the present invention.

Next, when a width W2 of the recording sheet 5 is the first threshold w1 or more and less than the second threshold (w1≤W2<w2), as illustrated in FIG. 9, both end portions of the recording sheet 5 in the direction intersecting the transport direction are guided by the second guide plates $\mathbf{571}_2$ and $\mathbf{571}_{10}$ of the second transport guide 57. Furthermore, a central portion of the recording sheet 5 in the width direction is guided along the first guide plates $\mathbf{571}_3$ to $\mathbf{571}_9$ of the second transport guide 57. As a result, the recording sheet 5 is guided to the first transport guide 58 in a slightly curved state in which both the end portions of the non-image side (back side) of the recording sheet 5 are in contact with proximal end portions and the upper end parts of the second guide plates $\mathbf{571}_2$ and $\mathbf{571}_{10}$ of the second transport guide 57 and the central portion of the non-image side (back side) is in contact with the proximal end portions and the upper end parts of the first guide plates $\mathbf{571}_3$ to $\mathbf{571}_9$.

Figure 11B:
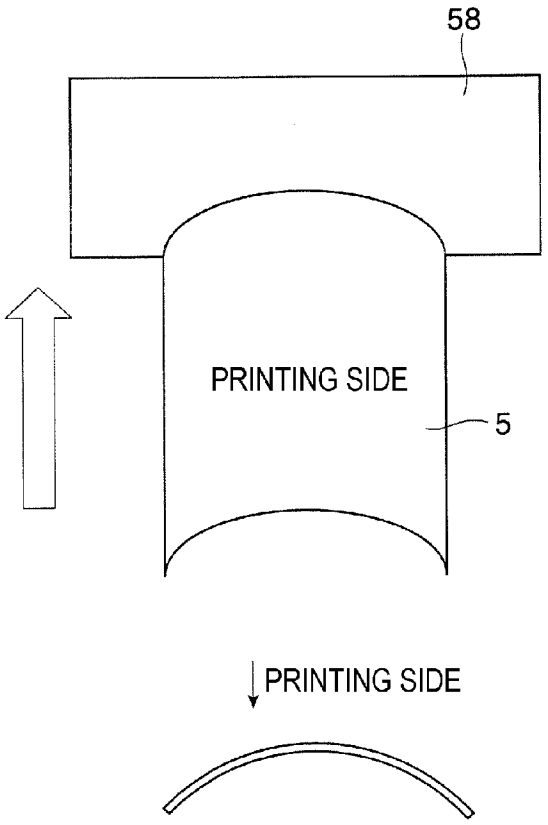
FIG. 11B RELATED ART
FIGS. 11A and 11B respectively illustrate the operation of the sheet transport apparatus according to the first exemplary embodiment of the present invention and an operation of a related-art sheet transport apparatus.
Figure 11A:
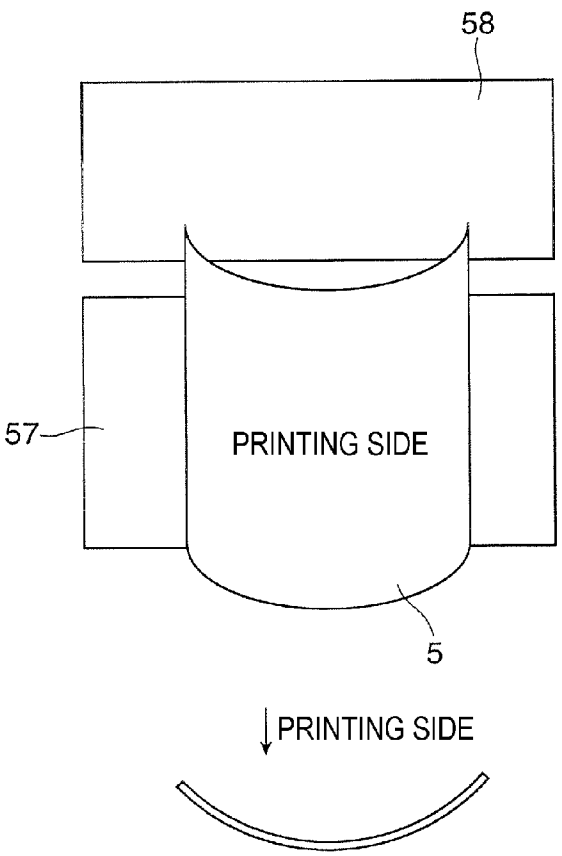

Thus, the recording sheet 5 having been guided to the first transport guide 58 is guided to the nip of the fixing device 40 as illustrated in FIG. 11A by the first transport guide 58 as follows: initially, the central portion in the width direction of the edge of the leading end of the recording sheet 5 is brought into contact with the surface of the first transport guide 58 having a flat plate shape; then, both the end portions of the recording sheet 5 in the width direction are gradually brought into contact with the surface of the first transport guide 58 having a flat plate shape; thus, the recording sheet 5 assumes the flat state and is guided to the nip of the fixing device 40.

Figure 10:
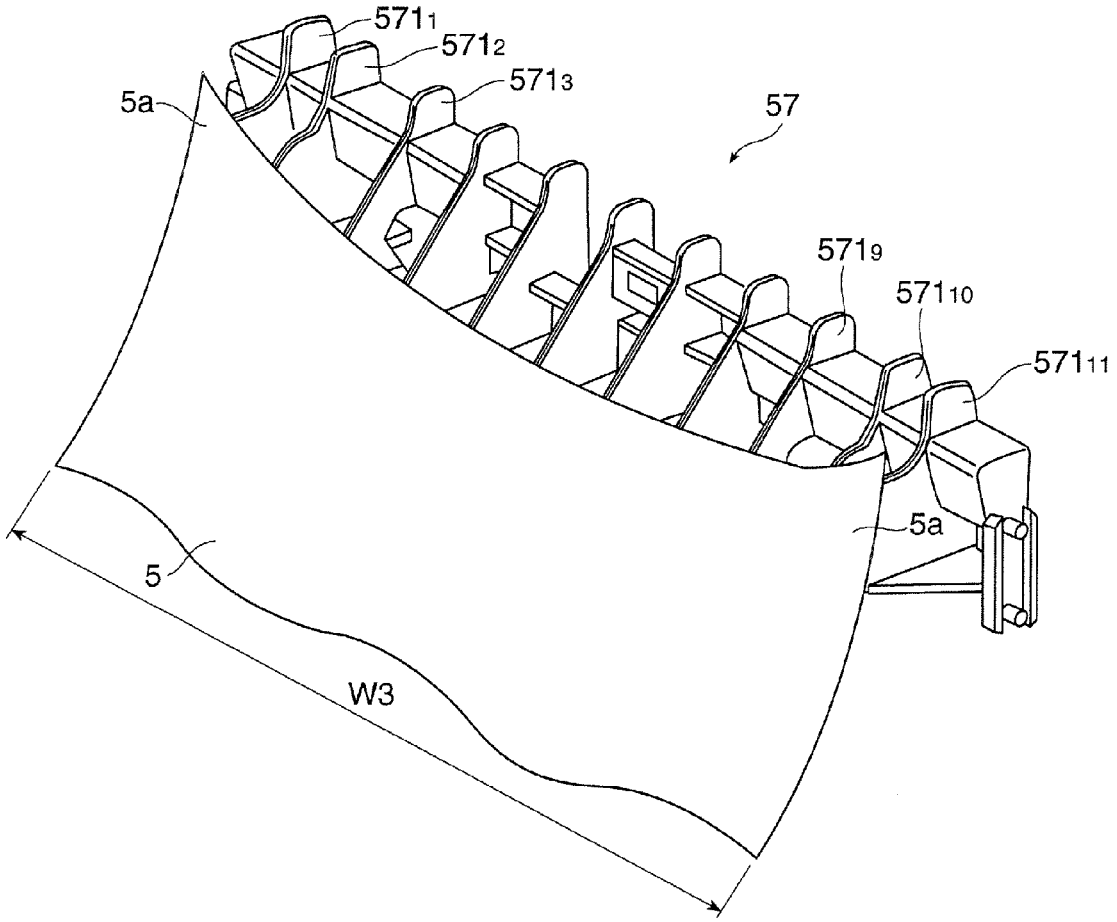
FIG. 10 illustrates the operation of the sheet transport apparatus according to the first exemplary embodiment of the present invention.

Furthermore, when a width W3 of the recording sheet 5 is the second threshold w2 or more, as illustrated in FIG. 10, both the end portions of the recording sheet 5 in the width direction are guided by the second guide plates $\mathbf{571}_2$ and $\mathbf{571}_{10}$ and the third guide plates $\mathbf{571}_1$ and $\mathbf{571}_{11}$ of the second transport guide 57. Furthermore, the central portion of the recording sheet 5 in the direction intersecting the transport direction is guided along the first guide plates $\mathbf{571}_3$ to $\mathbf{571}_9$ of the second transport guide 57. As a result, as illustrated in FIG. 11A, the recording sheet 5 is guided to the first transport guide 58 in a greatly curved state in which both the end portions of the non-image side (back side) of the recording sheet 5 are in contact with the proximal end portions and the upper end parts of the second guide plates $\mathbf{571}_2$ and $\mathbf{571}_{10}$ and the third guide plates $\mathbf{571}_1$ and $\mathbf{571}_{11}$ of the second transport guide 57, and the central portion of the non-image side (back side) is in contact with the proximal end portions and the upper end parts of the first guide plates $\mathbf{571}_3$ to $\mathbf{571}_9$.

Figure 12:
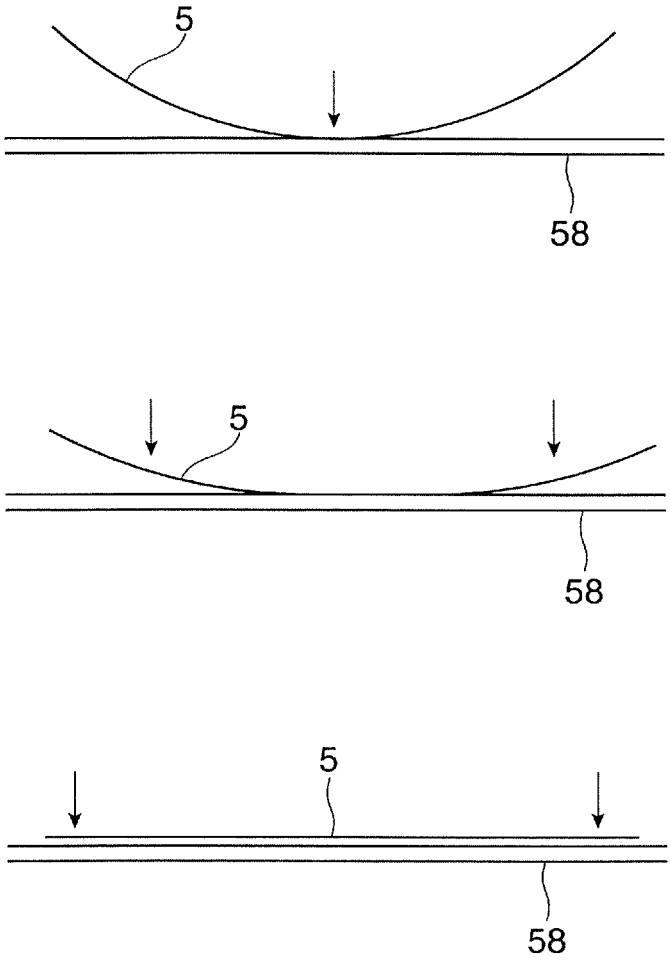
FIG. 12 illustrates the operation of the sheet transport apparatus according to the first exemplary embodiment of the present invention.

Thus, the recording sheet 5 having been guided to the first transport guide 58 is guided to the nip of the fixing device 40 as illustrated in FIG. 11A and FIG. 12 by the first transport guide 58 as follows: initially, the central portion in the width direction of the edge of the leading end of the recording sheet 5 is brought into contact with the surface of the first transport guide 58 having a flat plate shape; then, both the end portions of the recording sheet 5 in the width direction are gradually brought into contact with the surface of the first transport guide 58 having a flat plate shape; thus, the recording sheet 5 assumes the flat state and is guided to the nip of the fixing device 40.

Thus, even when the recording sheet 5 is thin paper having a comparatively small basis weight, the recording sheet 5 is set in the flat state by the initial contact of the central portion in the width direction of the edge of the leading end of the recording sheet 5 with the surface of the first transport guide 58 having a flat plate shape and the succeeding contact with the surface of the first transport guide 58 having a flat plate shape occurring gradually toward both the end portions of the recording sheet 5 in the width direction.

Figure 13:
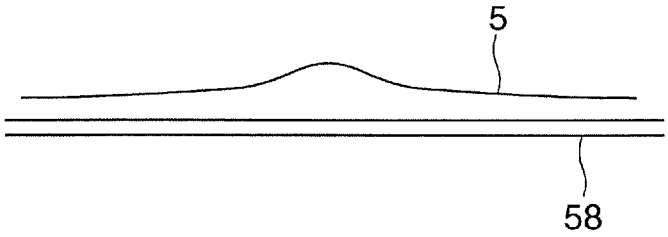
FIG. 13 RELATED ART
FIG. 13 illustrates the operation of the related-art sheet transport apparatus.

In contrast, in the case of a related-art sheet transport apparatus, the recording sheet 5 is transported through the first transport guide 58 in such a manner that the printing side of the recording sheet 5 is convex as illustrated in FIGS. 11B and 13. Thus, both the end portions in the width direction of the recording sheet 5 is initially brought into contact with the first transport guide 58, and then the recording sheet 5 is brought into contact with the first transport guide 58 gradually from both the end portions toward the central portion in the width direction. As a result, the recording sheet 5 is in contact with the first transport guide 58 in such a state that distortion is concentrated in the central portion in the width direction. Thus, the distortion is likely to be concentrated in the width direction, and accordingly, wrinkling of the recording sheet 5 may occur, particularly in the case where the recording sheet 5 is thin paper having a comparatively small basis weight.

As has been described, according to the above-described exemplary embodiment, the wrinkling of the recording sheet 5 may be suppressed compared to the case where both the end portions of the recording sheet 5 in the direction intersecting the transport direction is initially brought into contact with the guide member.

Second Exemplary Embodiment

Figure 14:
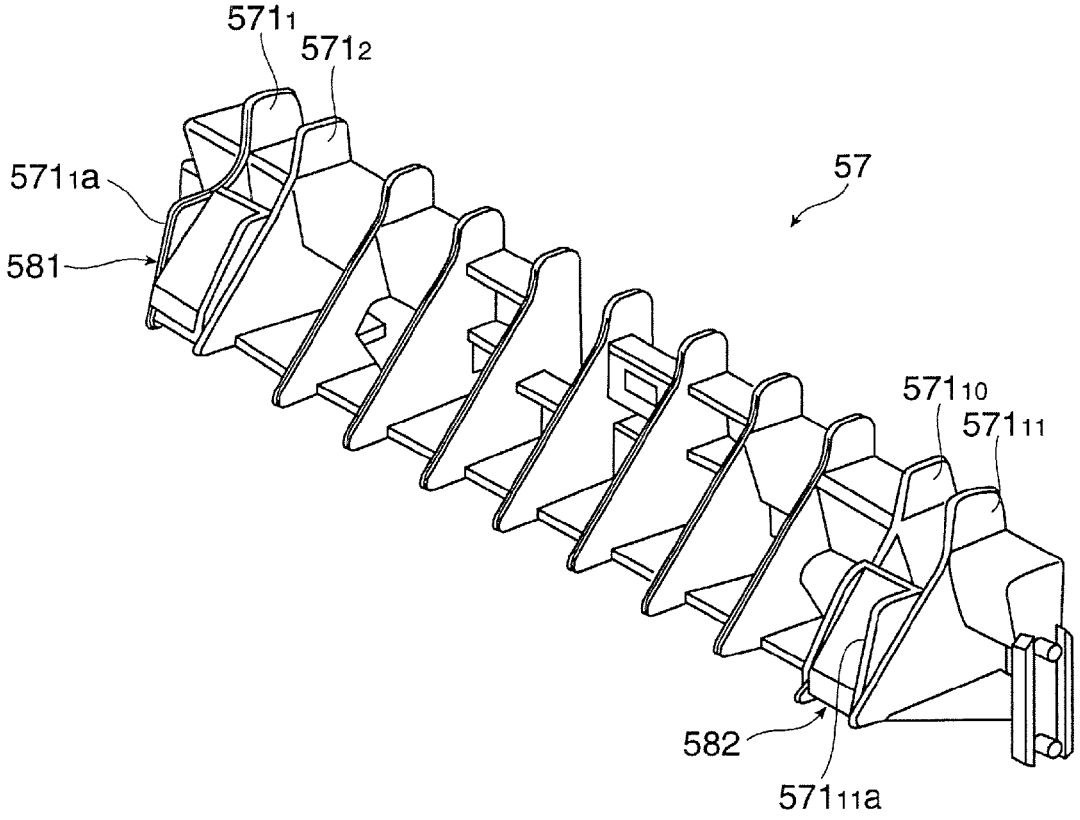
FIG. 14 is a perspective view of a structure of part of a sheet transport apparatus according to a second exemplary embodiment of the present invention.

FIG. 14 is a perspective view of a structure of part of a sheet transport apparatus according to a second exemplary embodiment of the present invention.

As illustrated in FIG. 14, according to the second exemplary embodiment, part of the second transport guide 57 is formed as separate components instead of being integrally formed with the second transport guide 57. All the guide plates $\mathbf{571}_1$ to $\mathbf{571}_{11}$ of the second transport guide 57 are formed similarly to or in the same manner as the first guide plates $\mathbf{571}_3$ to $\mathbf{571}_9$. Furthermore, the second transport guide 57 includes separate members 581 and 582 which are provided to the second transport guide 57 by, for example, press-fitting or bonding. A left side edge that is similar to or the same as the left side edges $\mathbf{571}_2a$ and $\mathbf{571}_{10}a$ of the second guide plates $\mathbf{571}_2$ and $\mathbf{571}_{10}$ and a left side edge that is similar to or the same as the left side edges $\mathbf{571}_1a$ and $\mathbf{571}_{11}a$ (proximal end portions) of the third guide plates $\mathbf{571}_1$ and $\mathbf{571}_{11}$ are integrally formed with each of the separate members 581 and 582.

According to the second exemplary embodiment, the transport guide may be easily formed, and accordingly, the production cost may be reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport apparatus comprising:

a first transport device that transports in a transport direction a sheet having one end portion and another end portion in a direction intersecting the transport direction and having a length of a preset value or more in the direction intersecting the transport direction;

a second transport device that is disposed downstream of the first transport device in the transport direction and that transports the sheet;

a first guide member that has a flat plate shape, that has a surface, that is disposed between the first transport device and the second transport device such that the second transport device is closer to the first guide member than the first transport device, and that guides the sheet to the second transport device; and a second guide member that is disposed between the first transport device and the second transport device such that the first transport device is closer to the second guide member than the second transport device and that guides the sheet to the first guide member while curving the sheet such that the one end portion of the sheet and the other end portion of the sheet are separated from the surface of the first guide member, wherein the second guide member includes a plurality of guide plates that have flat plate shapes in the transport direction and that are arranged in the direction intersecting the transport direction, and wherein the plurality of guide plates comprises a first plurality of back-to-back guide plates that are disposed within a range having a preset length in the direction intersecting the transport direction forms a surface along a transport plane in which the sheet is transported by the first transport device.

2. The sheet transport apparatus according to claim 1, wherein the first transport device and the second transport device are disposed such that the transport direction of the sheet transported by the first transport device and the transport direction of the sheet transported by the second transport device form an obtuse angle.

3. The sheet transport apparatus according to claim 1, wherein the second guide member has one end portion and another end portion in the direction perpendicular to the transport direction and includes a plurality of guide plates that have flat plate shapes in the transport direction and that are arranged in the direction intersecting the transport direction, and wherein, out of the plurality of guide plates, one of the plurality of guide plates disposed at the one end portion of the second guide member and another one of the plurality of guide plates disposed at the other end portion of the second guide member project relative to a transport plane in which the sheet is transported by the first transport device.

4. The sheet transport apparatus according to claim 2, wherein the second guide member has one end portion and another end portion in the direction perpendicular to the transport direction and includes a plurality of guide plates that have flat plate shapes in the transport direction and that are arranged in the direction intersecting the transport direction, and wherein, out of the plurality of guide plates, one of the plurality of guide plates disposed at the one end portion of the second guide member and another one of the plurality of guide plates disposed at the other end portion of the second guide member project relative to a transport plane in which the sheet is transported by the first transport device.

5. The sheet transport apparatus according to claim 1, wherein the second guide member has a downstream end portion in the transport direction of the sheet, and wherein the second guide member includes a redirect structure that is disposed at the downstream end portion thereof and that changes the transport direction of the sheet toward the first guide member.

6. The sheet transport apparatus according to claim 2, wherein the second guide member has a downstream end portion in the transport direction of the sheet, and wherein the second guide member includes a redirect structure that is disposed at the downstream end portion thereof and that changes the transport direction of the sheet toward the first guide member.

7. The sheet transport apparatus according to claim 3, wherein the second guide member has a downstream end portion in the transport direction of the sheet, and wherein the second guide member includes a redirect structure that is disposed at the downstream end portion thereof and that changes the transport direction of the sheet toward the first guide member.

8. The sheet transport apparatus according to claim 4, wherein the second guide member has a downstream end portion in the transport direction of the sheet, and wherein the second guide member includes a redirect structure that is disposed at the downstream end portion thereof and that changes the transport direction of the sheet toward the first guide member.

9. An image forming apparatus comprising:

an image holding body that holds a toner image;

a transfer unit that transfers the toner image held by the image holding body to a recording medium;

a fixing device that fixes the toner image to the recording medium to which the toner image has been transferred by the transfer unit; and the sheet transport apparatus according to claim 1 in which the transfer unit is the first transport device and the fixing device is the second transport device.

10. The sheet transport apparatus according to claim 1, wherein the plurality of back-to-back guide plates have a substantially triangular shape.

11. The sheet transport apparatus according to claim 1, wherein the plurality of guide plates further comprises a second plurality of guide plates, different from the first plurality of back-to-back guide plates, having left side edges that are inclined at an angle that is greater than an angle at which the first plurality of back-to-back guide plates are inclined, relative to a horizontal direction.

12. The sheet transport apparatus according to claim 11, wherein at least one of the second plurality of guide plates is disposed at one end of the first plurality of back-to-back guide plates, and at least one of the second plurality of guide plates is disposed at the opposite end of the first plurality of back-to-back guide plates.

13. The sheet transport apparatus according to claim 11, wherein the plurality of guide plates further comprises a third plurality of guide plates, different from the first plurality of back-to-back guide plates and the second plurality of guide plates, wherein at least one of the third plurality of guide plates is disposed at one end of the second plurality of plates, and at least one of the third plurality of guide plates is disposed at the opposite end of the second plurality guide plates, such that the first plurality of back-to-back guide plates and the second plurality guide plates are disposed between the third plurality of guide plates.

14. The sheet transport apparatus according to claim 13, wherein the third plurality guide plates have a substantially trapezoidal shape.

15. The sheet transport apparatus according to claim 13, wherein the third plurality guide plates have left side edges that are inclined at an angle that is greater than the angle at which the second plurality plates are inclined, relative to a horizontal direction.

* * * * *